United States Patent [19]

Joseloff

[11] 4,330,048

[45] May 18, 1982

[54] COOPERATIVE BAGGING CHECK-OUT COUNTER

[76] Inventor: Stanley S. Joseloff, 217 Webb Rd., Fairfield, Conn. 06432

[21] Appl. No.: 21,558

[22] Filed: Mar. 19, 1979

[51] Int. Cl.[3] ..... B65B 67/12

[52] U.S. Cl. ..... 186/66

[58] Field of Search ..... 186/1 V, 1 W, 1 AA

[56] References Cited

U.S. PATENT DOCUMENTS 3,126,981 3/1964 Crawford ..... 186/1 W 3,715,862 2/1973 Schohl ..... 186/1 V

*Primary Examiner*—Stanley H. Tollberg

*Attorney, Agent, or Firm*—Charles E. Temko

[57] ABSTRACT

A cooperative bagging check-out counter for supermarkets and the like is provided which permits maximum traffic handling with minimum of personnel by providing, within conventional checkout counter dimensions, improved accessibility of bags, more convenient bag-filling orientation, more efficient distribution of unbagged items, and with all of the foregoing directed both to the cashier and the customer on their respective sides of the counter for maximal cooperative check-out speeding efforts. An elongated check-out counter is provided with a receiving station on one end thereof having a conveyor thereon, a storage station on the other end thereof having a rotary table thereon, and a cashier station is positioned intermediate the receiving and storage stations. The cashier station is recessed with an angular section to permit the cashier positioned in front thereof to face the conveyor at an angle to enable the handling of on-coming items with an efficient swimming motion. Bag loading wells are located in the angled section of the counter and a scanner, when used, is positioned in front of the bag loading wells. First and second bag dispensers are provided under the storage station with one facing the rear of the cashier station and the other being in the end of the storage station facing the customer. Bag loading wells are also provided at the front of the storage station facing the customer wherein both the cashier and customer have ready access to dispensed bags as well as a convenient place to load them.

7 Claims, 3 Drawing Figures

COOPERATIVE BAGGING CHECK-OUT COUNTER

BACKGROUND OF THE INVENTION

This invention relates to check-out counters for supermarkets and the like, and more particularly to new and improved check-out counters for increasing the ease, speed and economy in the flow of customers and merchandise through the establishments in which they are installed.

The very existence and purpose of supermarkets and the like is based on speed and economy in the flow of both merchandise and customers through the store. The lay out of such retail establishments and the equipment installed therein are designed to facilitate and promote the ease and rapidity of flow. Inspite of these efforts, however, serious bottlenecks continue to exist particularly at the check-out counter which is a frequent source of long and often irritating delays. In peak periods, in fact, the on line delays result in carts being backed up at the check-out counter into the store aisles, making it difficult for customers who have not yet finished shopping from moving with ease through the aisles positioned near the check-out counters.

One solution to the problem has been to install a larger number of check-out stations which is costly because of space and personnel requirements and is also limited by the amount of space available. Other methods involve the use of various apparatus at the counters involving special equipment and counter constructions which are complex, expensive and not always fully satisfactory.

In spite of the various proposals which have been advanced, the flow of traffic through supermarket check-outs continues to be one of industry's most fustrating challenges. With the advent of computer technology at the check-out counter, the use of scanning devices for price totaling, etc., has saved precious minutes from the totalizing process, but unfortunately has compounded the bottleneck beyond the scanner at the bagging stage. One such scanner-equipped check-out counter is divided into two approximately equal lengths. The cashier stands in an open area between the two lengths with the abdomen abutting the end of the first length, about one foot in back of a window scanner in the counter. The cashier, using a sweeping swimming motion, pulls items over the scanning window with two hands and sweeps them into two open bags standing on a knee-level shelf located between the cashier and the end of the counter. This system has proved to be efficient and the swimming motion has tested out as being the fastest and least fatiguing. In fact, everything about the method has gained favor, except for one very important deficiency which occurs whenever traffic piles up, and particularly when there is a flow of more-than-the-two-bag size of order. The cashier is no longer able to cope with the back up of merchandise and is compelled to resort to a time and space wasting tactic of halting all activity and lifting a ramp into the space in which she has been standing. The cashier must abandon bagging, and instead must pass the scanned items over the ramp either to be bagged by an extra, auxiliary (and costly) bagger or else the diverted items must wait at the end of the ramp until later bagged by the cashier. During this latter bagging operation, the cashier is occupied and is not free to continue ringing up items. Either alternative is bad and demands a remedy.

Coupled with the disadvantage of the above set-up is the fact that a customer, no matter how willing to cooperate in the bagging process in order to move out faster, is virtually precluded from helping. The customer can do nothing about bagging as the cashier engages in the "swimming" motion of sweeping items into bags, nor can the customer do an appreciable amount of bagging, if any, at the point where items are being directed remotely from the cashier over the ramp.

These difficulties do not confine themselves to markets with scanning devices. In a conventional supermarket, particularly the great majority where costly auxiliary baggers are not employed, all ring-up activity stops, and the other customers waiting in line must wait while the cashier locates a spot on the crowded counter to bottom a bag and fill it from the jumble of items surrounding her. There is no provision for an open bag or bags within a conventional check-out counter into which the cashier can sweep items simultaneously with her ringing them up and certainly there is no such facility for a willing customer to do so. As a matter of fact, it takes considerable doing even to find an empty bag which, because of inadequate counter space, is hidden somewhere under the rear of counter. Even after the bag is found, further difficulty is encountered in finding a place to sit it down on the crowded counter, where one hand must hold the bag erect as the other hand fills it.

SUMMARY OF THE INVENTION

Accordingly, it is among the objects of the present invention to provide a new and improved cooperative bagging check-out counter which increases the speed and economy of the check-out operation.

Another object of this invention is to provide a new and improved cooperative bagging check-out counter which is simple in construction, can be employed in presently available space and requires no elaborate special mechanical equipment in the operation of the check-out and bagging functions.

A still further object of the present invention is to provide a new and novel cooperative bagging check-out counter which permits simultaneous bagging by both the cashier and the customer without the cashier having to leave the cash register unattended and at the same time permitting the customer to view the entire check-out operation of the cashier.

Still another object of this invention is to provide a new and improved check-out counter which permits simultaneously and/or independent cashier and customer bagging by the utilizing of heretofore unused counter and undercounter space for both the dispensing of empty bags and the placement of to-be-filled bags in fixed space on or partially in the counter.

A further object of this invention is to provide a new and improved check-out counter to provide a continuously clearable space on the counter for the selection of to-be-bagged items on which unbagged items can be movably stored to provide ready access thereto by both the cashier and customer.

A still further object of this invention is to provide a new and improved check-out counter which permits the cashier to use an easy, convenient, and efficient head-on swimming motion to sweep items into waiting bags for simultaneous bagging whether using a scanner or a conventional cash register check-out system regardless of the size of the order or the amount of traffic at the check-out counter.

Another object of this invention is to provide a new and improved check-out counter to encourage and induce customer cooperation in the check-out process for faster check-out movement, reduced labor cost, and greater, overall productivity.

In carrying out this invention in one illustrative embodiment thereof, an elongated check-out counter is provided having a receiving station with a conveyor thereon at one end thereof, a storage station having a rotary table thereon at the other end thereof and a cashier station intermediate said receiving and storage stations. The cashier station is provided with a biased recess accommodating the positioning of a cashier therein facing said conveyor at an angle thereby enabling the cashier to handle items from the conveyor head on with a sweeping, swimming motion. A first bag loading means is provided in the biased recess to enable the simultaneous bagging by the cashier as the items are checked. The storage station has a rotary table positioned on the top thereof and a first bag dispensing means is housed therein facing the cashier station to provide bags for the cashier. In the storage station on the customer side of the counter a second bag loading means is positioned diagonally across from the cashier station. A second bag dispensing means is positioned under the rear of the storage station facing the customer and adjacent the second bag loading means thereby providing the customer with bags and a location in the counter to permit customer bagging. The rotary table at the storage station provides access to unbagged items to both the customer and cashier.

The counter may employ a scanner which would be positioned directly in front of the first bag loading means or may be utilized without a scanner in the conventional cash register mode.

BRIEF DESCRIPTION OF THE DRAWINGS

Further aspects, objects and features of this invention will best be understood from the following description taken in connection with the accompanying drawings.

DESCRIPTION OF THE PREFERRED EMBODIMENTS

Figure 1:
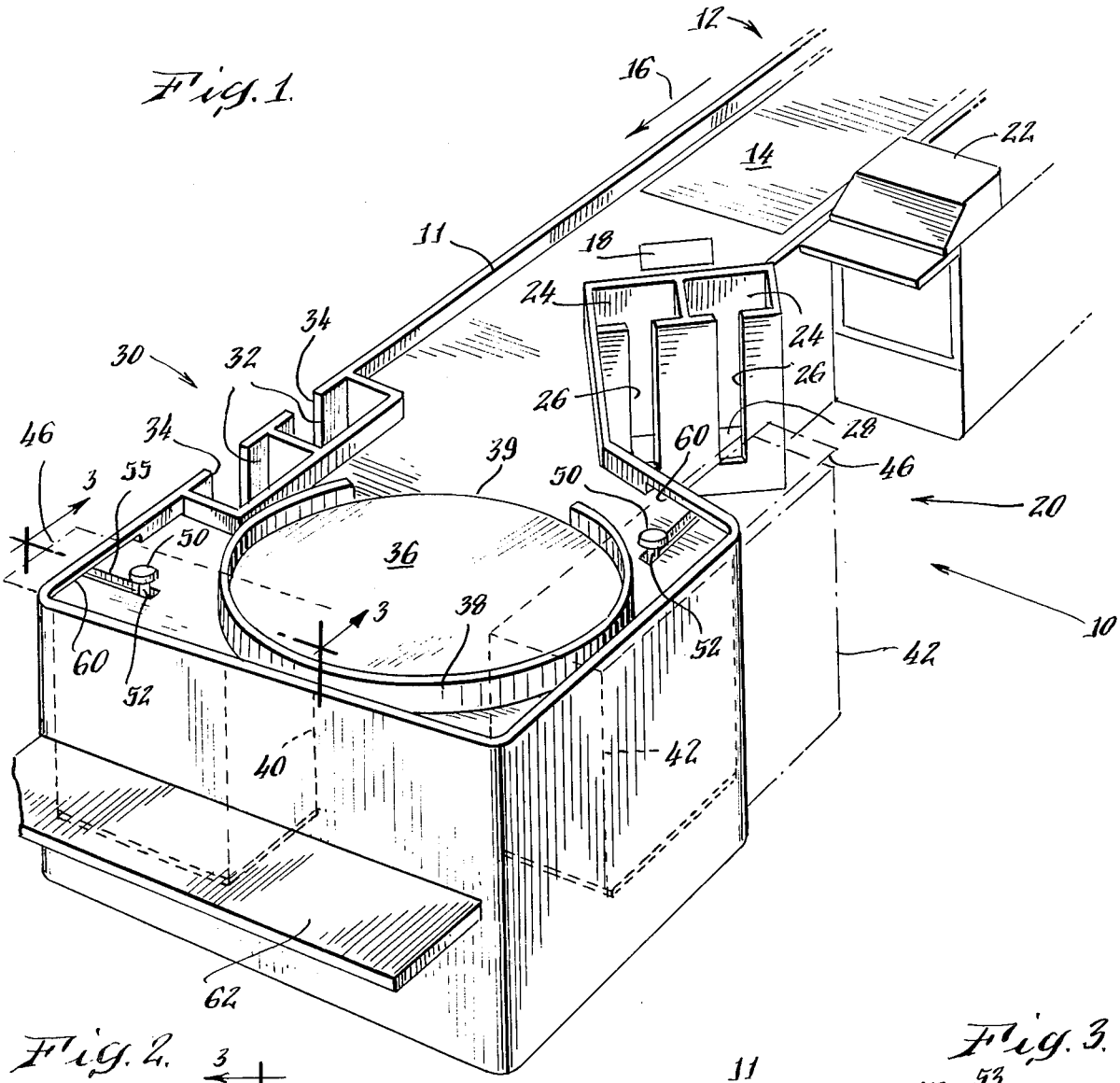
FIG. 1 is an isometric view of an illustrative embodiment of the new and novel cooperative bagging check-out counter in accordance with the present invention.

Referring now to FIG. 1 an illustrative embodiment of the cooperative bagging check-out counter in accordance with the present invention is designated generally with the reference numeral 10. The check-out counter 10 is elongated and generally comprises a receiving station 12, a cashier or check-out station 20 and a loading or storage station 30. The check-out counter 10 is provided with a protective railing 11 along selected portions thereof in order to prevent merchandise from falling off the counter.

The receiving station 12 is positioned on the forward end of the counter 10 and is utilized to receive groceries or items to be checked out that a customer will normally deliver to the check-out counter 10 in a shopping cart which is provided by the store. The cart is positioned in the customer aisle 16 on the customer's side of the counter 10 and the articles are removed from the cart and placed on the top of the counter at the receiving station 12 which may be provided by a suitable conveyor 14 of conventional form for moving the items deposited thereon forward toward the cashier station 20.

The cashier station 20 is located in an intermediate portion of the check-out counter 10 between the receiving station 12 and the loading or storage station 30. The check-out counter 10 is recessed and biased at 19 at the cashier station 20 such as to facilitate the positioning of the cashier facing on coming items from the conveyor 14. The cashier station includes a cash register or computer 22 on which the checked-out items are tabulated. As is illustrated in FIG. 1, a scanner mechanism 18 is provided which in combination with the cash register or computer 22 is adapted to compute the total charge for the merchandise purchased as well as maintaining a running inventory of merchandise. The scanner 18 functions to scan coded indicia on the goods moved over the scanner by the cashier. Although this is the preferred form, it will be appreciated that the bagging check-out counter 10 in accordance with the present invention may be utilized with the conventional cash register 22 which is manually operated by the cashier.

The cashier station includes a pair of vertically extending cashier bag loading wells 24 which terminate in a shelf 28. Alternatively, the shelf itself may comprise the bag loading wells. The bag wells 24 may have a size and are shaped to accommodate two open standard No. 50 size bags which are approximately 17" long and 12" wide but it will be appreciated that the wells may accommodate the loading of different size bags.

The bag wells 24 are positioned side-by-side in the angled recess 19 and are directly in front of the cashier positioned at the cashier station 20. The front surface of the bag wells 24 are slotted at 26 for the entire length thereof to accommodate the insertion of the hand therein to facilitate removal of the loaded bags from the bag wells. Alternatively, the shelf 28 may be used for the cashier bag loading means which may include some form of protective railing.

The loading or storage station 30 also includes a pair of side-by-side bag wells 32 having slots 34 facing the customer aisle 16. Bag wells 32 are positioned diagonally across from the cashier station. The storage station 30 includes a large rotary table 36 having a railing 38 therearound with an opening 39 therein forming a mouth for moving articles onto the rotary table 36. The rotary table 36 is preferably in the form of a manually operated enlarged lazy-susan or alternatively could be motor driven if so desired. Items which have been checked but not bagged by the cashier are moved by the cashier to the rotary table 36 where they are temporarily stored for bagging by either the customer or the cashier.

The loading station 30 also includes a pair of handle operated bag dispensing means 40 and 41 of the same construction, one of which is accessible to the customer or an auxiliary loader, and the other of which faces and is accessible to the cashier and which are distinguished by referring to them as either the customer or cashier bag dispensers. Since the bag dispensers are of the same construction only one is described but the same reference characters as used for like elements on both.

Figure 2:
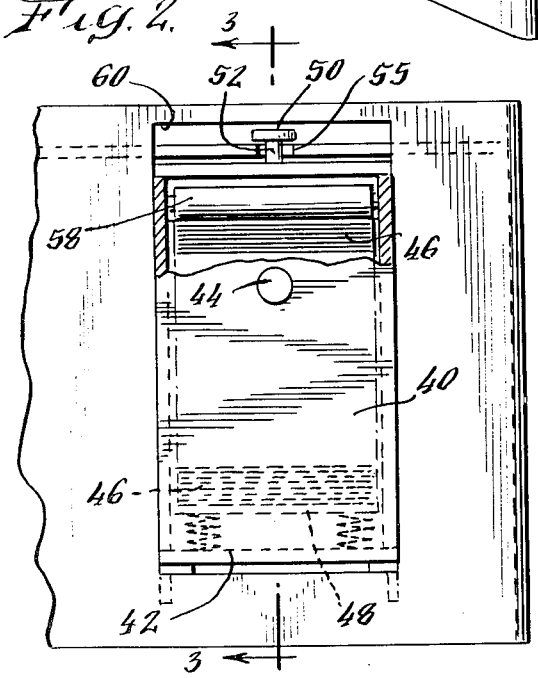
FIG. 2 is a front plan view illustrating the type of manual bag dispensing means employed in the present invention.
Figure 3:
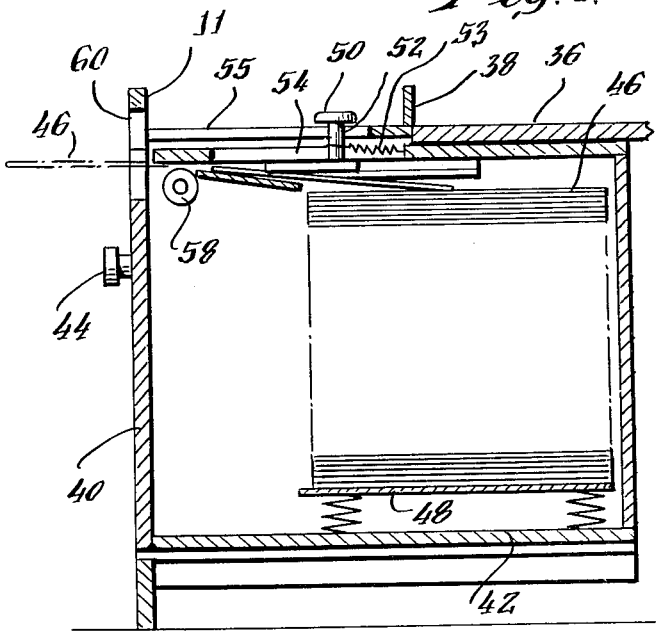
FIG. 3 is a cross-sectional view taken along line 3—3 of FIG. 2.

The handle operated bag dispensers 40, details of which will best be seen with reference to FIGS. 2 and 3, include a bag drawer 42 having a handle 44 thereon in which a plurality of bags 46 are stored. The drawer 42 is large enough to accommodate the standard size bag most commonly utilized in supermarkets. The bags 46 lying horizontally in the drawer 42 are positioned on a spring loaded shelf 48 which urges the bags vertically upward. A manual actuator is provided for the bag dispenser 40 in the form of a handle 50 attached by an arm 52 to a friction plate 54. The arm 52 is positioned in a guideway 55 through the upper surface of the counter 10 at the loading station 30. The arm 52 is provided with a return spring 53 which is attached thereto. The arm 52 which extends into the drawer 42 carries the friction plate 54 which is in contact with the uppermost bag 46 in the drawer, the bags being urged into contact therewith by the spring loaded shelf 48. A short inclined ramp 56 is positioned forward in the upper portion of the drawer 42 and a friction roller 58 is positioned in front of the inclined ramp 56. The counter railing 11 has a slot 60 therein through which bags 46 may be dispensed. The ramp 56 and friction roller 58 direct and deflect the individual bags 46 out of the slot 60.

In the operation of the bag dispenser, the drawer 42 is opened and a stack of bags is deposited horizontally therein. The drawer is closed and the spring loaded shelf 48 functions to urge the bags 46 into engagement with the underside of the friction plate 54. The handle 50 is operated in the guideway 55 urging the uppermost bag onto the inclined ramp 56 which directs the bag upward into contact with the roller 58 and out of the slot 60 so that it may be removed therefrom by the user. The friction roller 58 functions to deflect the bag out the slot and to aid in preventing the dispensing of more than one bag at a time. When a bag 46 is removed, the handle 50 is automatically returned to its initial position by the action of return spring 53. The friction plate 54 contacts the next bag moving it rearward toward the back of the drawer which functions not only to loosen the uppermost bag, thereby aiding in separating the bags but to position the bag with respect to the ramp 56 so that the next forward movement of the handle 50 in the guideway 55 provides the user with access to the next bag.

The customer bag dispensing means 40 is positioned at the rear of the loading station 30 facing the customer aisle 16 thereby being operable by the customer in proximity to the customer bag wells 34. The cashier bag wells 24 are positioned diagonally with respect to the customer bag wells 34. The cashier bag dispenser faces the rear of the cashier station 20 making the cashier bag dispensing means accessible to the cashier in close proximity to the cashier bag wells 24.

An auxiliary shelf 62 may be provided at the end of the storage station 30 for use by an auxiliary bagger when required. The auxiliary bagger will have access to the customer bag dispenser 40 and may remove bags therefrom and place them on the shelf 62 bagging items which have been deposited on the rotary table 36.

Having now described the various stations and elements of the cooperative bagging check-out counter 10, the operation of the counter and the advantages associated therewith will now be described. A customer who has completed his item selections will move a shopping cart into the customer aisle 16 and deposit the articles at the receiving station 12 of the check-out counter 10 on the conveyor 14. The cashier positioned in the cashier station will operate the bag dispenser located thereat placing two bags in the bag wells 24. When the customer has unloaded his or her shopping cart, he or she will move it down the aisle. By having the customer bag dispenser 40 and the bag wells 34 readily accessible, the customer will be encouraged to remove bags from the bag dispenser 40, place them in the bag wells 34 in order to assist in the bagging operation. The dual bag wells at the cashier station enable sorting the checked-out items into different containers such that the heavy items can be equally distributed between the bags without disrupting the check-out operation, e.g. when one bag is already loaded with enough heavy items.

The cashier then begins the check-out by passing items over the scanner 18 using both hands in the efficient sweeping, swimming motion and inserting the items into the bags 46 positioned in the bag wells 24. If the volume becomes too heavy or the distribution of heavy items cannot be suitably made in the bagging operation by the cashier, the checked-out items may be passed by the cashier onto the rotary table 36. As the check-out proceeds, the cashier may remove a full bag from the bag well and deposit it on the rotary table and obtain further bags from the bag dispenser 40.

If a scanner is not used, the cashier can ring up items with one hand and pack or move items onto the rotary table with the other.

Unbagged items which have been placed on the rotary table 36 are accessible to the customer who is encouraged to bag simultaneously with the cashier as the items are being checked out. The positioning of the bag wells for the customer enables the customer to view the check-out operation and to be assured that the cashier has not made a mistake on the charges while the customer is helping with the bagging operation.

By enabling and enlisting customer assistance in the bagging operation, speed and economy are achieved which provides more sales per dollar and saves substantial labor costs. The simultaneous bagging provided by the cooperative bagging check-out counter 10 in accordance with the present invention provides for fast and easy check-out and bagging operations. Furthermore, the counter 10 makes items readily available for bag filling, provides an unjumbled even flow of items and permits two-handed confident bagging by either the checker or the customer or both or even by extra baggers if required. Furthermore, the customer in assisting in the bagging operation is in such a position along the counter that he can still see or observe the check-out operation but cannot remove the items before they are checked and passed to the loading station by the cashier. Furthermore, the bag wells and the bag dispensing means provide easy access to the bags and facilitate the bagging operation by holding the bags in position while they are being filled. This is a considerable improvement over those counters in which bags are virtually hidden and when found provide no counter space on which the bags may be placed and securely filled. The present invention has found new space to store bags which are easily accessible and to provide convenient space to load bags. The counter 10 is also simple mechanically, and does not require the placement or removal of awkward ramps to carry items to auxiliary baggers who are needed to handle bag filling because the customers are not doing so.

By encouraging the customer to assist in the bagging which provides for quicker exits and fewer fustrations, the entire movement of merchandise and people through the supermarket will be facilitated.

Since other modifications and changes varied to fit particular operating requirements and environments will be apparent to those skilled in the art, the invention is not considered limited to the examples chosen for purposes of illustration and covers all changes in modifications which do not constitute departures from the true spirit and scope of this invention.

What is claimed is:

1. In a cooperative bagging check-out counter for supermarkets and the like having an elongated counter having a principal longitudinal axis with a receiving station at one end thereof equipped with conveyor means moving parallel to said axis for the receipt and transport of items deposited thereon by a customer on a customer side of the counter, a storage station positioned at an opposite end of said counter, and a cashier station intermediate said receiving end storage stations, said cashier station receiving items to be checked out from said conveyor means, the improvement comprising: a recess in said cashier's station accommodating the positioning of a cashier therein facing said conveyor means at an angle with respect to said axis, thereby enabling the cashier to handle items from the conveyor with either or both hands in a sweeping, swimming motion; a rotary table positioned on top of said counter at said storage section; a bag loading positioning means located in said counter within said recess at said cashier's station; a first handle operated bag dispensing means within said counter for dispensing bags therefrom located in the front of said storage station facing the rear of said cashier station, thereby being readily accessible to a cashier; and a second handle operated bag dispensing means for dispensing bags therefrom disposed within said counter at the rear of said storage station facing said customer side of the counter, thereby enabling the customer to perform a bagging operation.

2. A cooperative bagging check-out counter, as set forth in claim 1, further characterized in said bag loading positioning means comprising side by side wells for accommodating two open bags therein.

3. A cooperative bagging check-out counter as set forth in claim 2, in which said bag wells are slotted along the length of a front surface thereof to allow the insertion of a hand therethrough to assist in removing loaded bags from said bag wells.

4. A cooperative bagging check-out counter as set forth in claim 1, wherein said first and second bag dispensing means each include a drawer positioned in said check-out counter and adapted to receive a stack of bags which are positioned horizontally therein on a resiliently biased shelf at the bottom of said drawer for urging said stack upwardly within said drawer.

5. A cooperative bagging check-out counter as set forth in claim 1, further characterized in said first and second bag dispensing means comprising means for housing a plurality of bags, a friction plate having a handle thereon positioned for slidable movement within an opening in said counter, and means for urging said bags into contact with said friction plate whereby upon movement of said handle, said friction plate engages the uppermost bag of said plurality of bags for dispensing said bag from said housing.

6. Improved bag dispensing means for use with a check-out counter having a horizontal wall and at least one vertical wall communicating with said horizontal wall, said horizontal wall having an elongated slot therein, said vertical wall having an opening therein, said bag dispensing means comprising: a slidingly movable drawer positioned in said opening in said vertical wall and beneath said horizontal wall for housing a stack of bags, spring means positioned within said drawer for resiliently urging said stack of bags toward the top of said drawer, a friction plate having an upwardly extending handle projection through said elongated opening in said horizontal wall, said plate being positioned for slidable movement in a substantially horizontal plane beneath said counter, and overlying an uppermost bag in said stack for the serial advancement thereof through said opening in said vertical wall, a ramp and a friction roller mounted in said drawer and positioned in line with said uppermost bag, and spring means interconnecting said handle and a part of said drawer to resiliently urge said friction plate to a position overlying said stack of bags.

7. In a check-out counter for supermarkets and the like having an elongated counter with a receiving station at one end thereof equipped with a conveyor means for the receipt and transport of items deposited thereon by a customer on the customer's side of the counter, a storage station positioned on the other end of said counter, and a cashier station intermediate said receiving and storage stations, said cashier station receiving items to be checked out from said conveyor means, the improvement comprising: a recess in said cashier's station accommodating the positioning of a cashier therein facing said conveyor means at an angle with respect to said access, thereby enabling the cashier to handle items from the conveyor with either or both hands in a sweeping, swimming motion; a rotary table positioned on top of said counter at said storage station; a bag loading positioning means located in said counter within said recess at said cashier's station; and bag dispensing means within said counter for dispensing bags therefrom located in the front of said storage station facing the rear of said cashier station, thereby being readily accessible to a cashier; whereby a cashier may selectively bag tallied articles immediately upon the completion of the tallying operation, or temporarily store such items downstream for subsequent retrieval to her for bagging.

* * * * *